United States Patent [19]

Gorman

[11] Patent Number: 5,048,835

[45] Date of Patent: Sep. 17, 1991

[54] WEIGHTED GOLF CLUB HEAD

[75] Inventor: Geoffrey W. Gorman, Greer, S.C.

[73] Assignee: Dunlop Slazenger Corp., Greenville, S.C.

[21] Appl. No.: 529,957

[22] Filed: May 29, 1990

[51] Int. Cl.[5] ..... A63B 53/04

[52] U.S. Cl. ..... 273/167 F; 273/167 H; 273/169

[58] Field of Search ..... 273/167 F, 167 H, 169, 273/171, 172

[56] References Cited

U.S. PATENT DOCUMENTS

| | | | |
|---|---|---|---|
| D. 229,434 | 11/1973 | Lrower | D34/5 GN |
| D. 267,965 | 2/1983 | Kobayashi | D21/220 |
| 2,087,685 | 7/1937 | Hackney | 273/77 |
| 2,846,228 | 8/1958 | Reach | 273/169 |
| 3,814,437 | 6/1974 | Winquist | 273/167 R |
| 4,128,244 | 12/1978 | Duclos | 273/164 |
| 4,136,877 | 1/1979 | Antonious | 273/164 |
| 4,325,553 | 4/1982 | Taylor | 273/167 F |
| 4,326,326 | 4/1982 | MacDonald | 273/167 F X |
| 4,355,808 | 10/1982 | Jernigan | 273/169 |
| 4,508,350 | 4/1985 | Duclos | 273/183 |
| 4,511,145 | 4/1985 | Schmidt | 273/167 H |
| 4,569,523 | 2/1986 | Jarvis | 273/164 |
| 4,621,813 | 11/1986 | Solheim | 273/77 A |
| 4,826,172 | 5/1989 | Antonious | 273/169 |
| 4,907,806 | 3/1990 | Antonious | 273/167 F X |
| 4,921,252 | 5/1990 | Antonious | 273/164 |
| 4,938,470 | 7/1990 | Antonious | 273/169 X |

*Primary Examiner*—William H. Grieb

*Attorney, Agent, or Firm*—Lorusso & Loud

[57] ABSTRACT

An iron type golf club head including heel, toe, bottom sole, top ridge and hosel portions, a face surface having a center of percussion, a rear surface, a peripheral mass formed on the rear surface and forming a cavity, a first weight portion extending from the rear surface and disposed behind the center of percussion, and a second weight means extending from the rear surface and at least in part spaced from the first weight portion.

11 Claims, 5 Drawing Sheets

WEIGHTED GOLF CLUB HEAD

CROSS-REFERENCE TO RELATED APPLICATIONS

This application is closely related by subject matter to U.S. application Ser. No. 07529,943, filed May 29, 1990, in the name of Geoffrey William Gorman entitled "An Iron Type Golf Club Head".

BACKGROUND OF THE INVENTION

1. Field of the Invention

This invention relates to instruments for impacting an object, and is directed more particularly to an iron type golf club head weighted for improved performance.

2. Description of the Prior Art

Attempts at improving the performance of golf clubs has produced a myriad of concepts, directed for the most part to improved distance through which a hit ball will travel and improved accuracy in both putting and driving.

One aspect of improvement has been in the area of weight distribution in iron type heads and one approach that has been used is peripheral or perimeter weighting, that is, locating weight around the periphery or perimeter of the club head. Peripheral weighting provides a cavity, or recess, centrally located in the back of the club head. An example of peripheral weighting may be found in U.S. Pat. No. 4,621,813, issued Nov. 11, 1986 to Karsten Solheim.

Others, rather than disversing weight around the periphery of a club head, have elected to concentrate weight midway of the club, or at a point approximately behind the center of percussion. An example of such an arrangement may be seen in U.S. Pat. No. 2,087,685, issued July 20, 1937 to Clarence W. Hackney. The Hackney club head is essentially a flat blade with a bulbous weight meater on the rear of the blade.

Still others have combined the perceived advantages of peripheral weighting with the perceived additional advantages of distributing weight within the cavity formed by peripheral weighting. Examples of such club heads may be seen in U.S. Pat. No. 3,814,437, issued June 14, 1974 in the name of S. William Winquist; U.S. Pat. No. 4,355,808, issued Oct. 26, 1982, in he name of Doyle D. Jernigon; and U.S. Pat. No. 4,826,172, issued May 2, 1989 in the name of Anthony J. Antonious. The Winquist patent shows a club head provided with perimeter weighting and, in addition, integral ribbing extending within the cavity at the rear of the club head, the ribbing being in the form of letters or symbols. Jernigon disposes a number of small weights along the bottom edge of the cavity and fills the cavity with epoxy. The object of Jernigon's invention is to tailor a club to an individual golfer's swing. The Antonious patent shows the use of perimeter weighting and weight members within the cavity, but removed from the center of percussion. The Antonious arrangement is said to assist the player most particularly with respect to miss-hit balls, that is, balls struck off the venter of percussion of the club head.

SUMMARY OF THE INVENTION

An object of the present invention is to provide an instrument, such as a golf club head, with a combination of perimeter weighting and additional weighting, the addtional weighting being disposed within the perimeter and, in part, immediately behind the center of percussion and, inpart, elsewhere inwardly of the perimeter weighting.

With the above and other objects in view, as will hereinafter appear, a feature of the present invention is the provision of an instrument for impacting an object the instrument including a head portion having a substantially flat face surface for engagement with the object, the object being smaller at its point of impact than the face surface, thin face surface having a center of percussion at which the face surface is adapted to engage the object upon impact, the head portion further having a rear surface, a peripheral mass formed in the rear surface and extending therefrom to form a cavity, a bottom of the cavity being defined by the rear surface, a first weight portion extending from the rear surface and being disposed behind the center of percussion, and a second weight means extending from the rear surface and being disposed within the peripheral mass and at least in part spaced from the first weight portion.

In accordance with a further feature of the invention, there is provided an iron type golf club head comprising heel, toe, bottom sole, top ridge and hosel portions, a face surface having a center of percussion, a rear surface, a peripheral mass formed on the rear surface adjacent the heel, toe, bottom sole and top ridge portions, the peripheral mass defining a cavity, a bottom of the cavity being defined by the area surface, a first weight portion extending from the rear surface and being disposed behind the center of percussion, and a second weight means extending from the rear surface and being disposed within the peripheral mass and at least in part spaced from the first weight portion.

The above and other features of the invention, including various novel details of construction and combination of parts, will now be more particularly described with reference to the accompanying drawings and pointed out in the claims. It will be understood that the particular device embodying the invention are is shown by way of illustrator only and not as limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
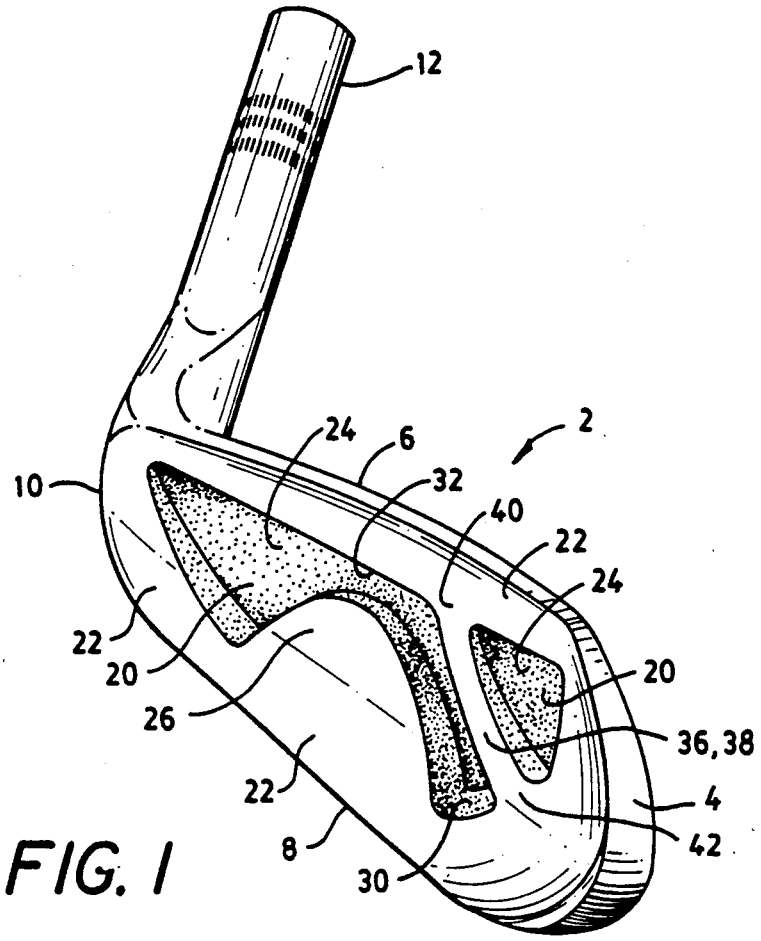
FIGS. 1 and 2 are perspective views of one form of golf club head illustrative of an embodiment of the invention.
Figure 2:
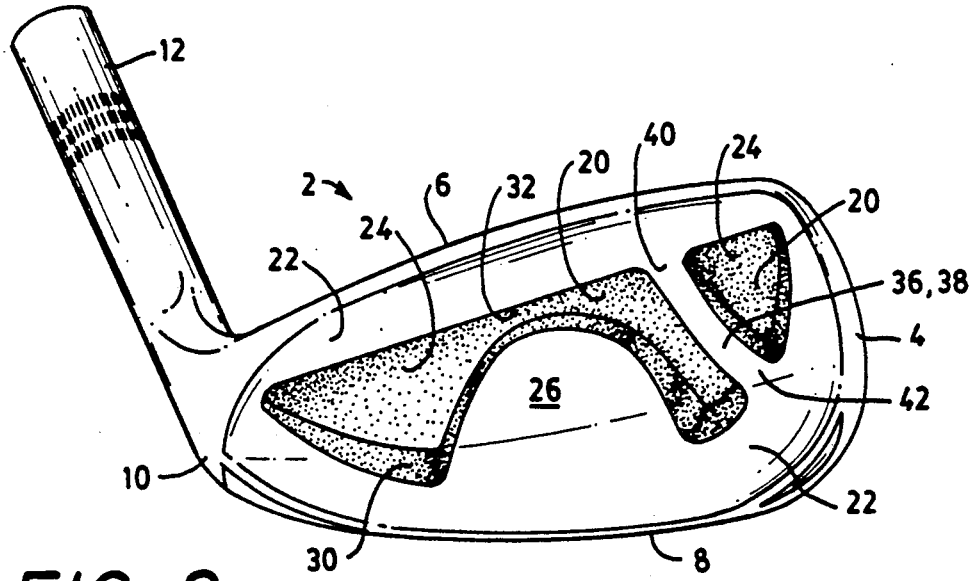
Figure 3:
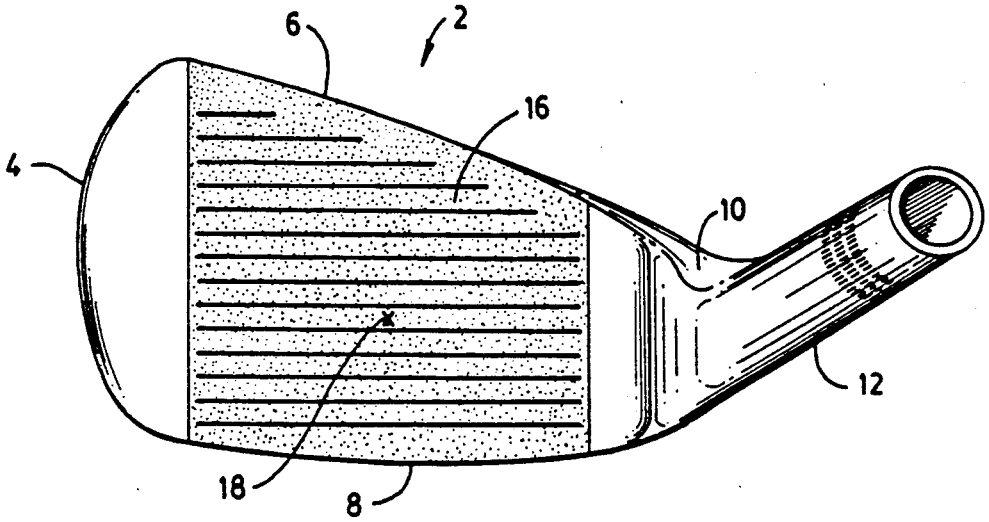
FIG. 3 is a front elevational view thereof.
Figure 4:
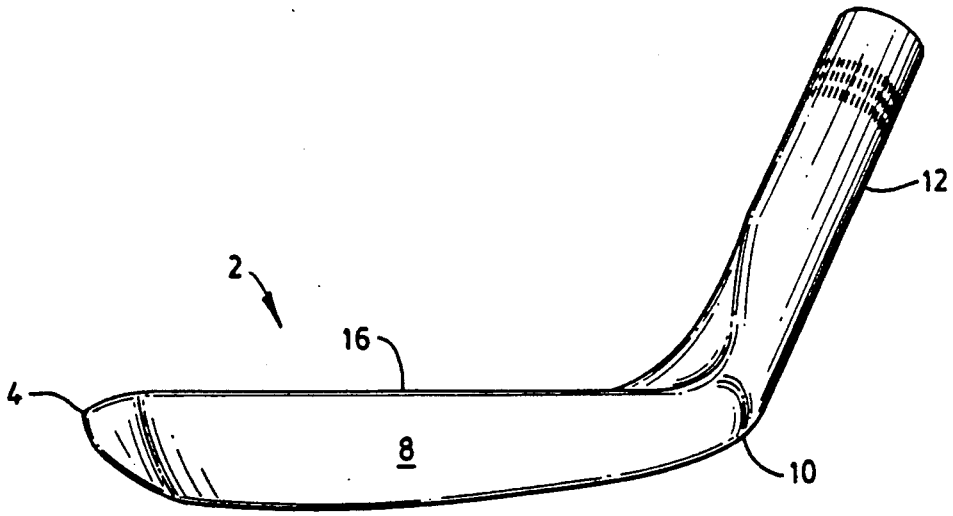
FIG. 4 is a bottom view thereof.

Referring to the drawings, and particularly FIGS. 1 and 2, it will be seen that the illustrative golf club head includes a blade member 2 having a toe portion 4, a top ridge portion 6, a bottom sole portion 8 and a heel portion 10. Extending from the heel portion region of the club head is a hosel portion 12 adapted to receive and be retained on a shaft member (not shown). The club head is provided with a substantially flat surface 16 (FIG. 3) having therein a center of percussion 18, which is the spot ideally adapted to engage a golf all at impact, and a rear surface 20 (FIGS. 1 and 2).

A peripheral mass 22 is formed on the rear surface 20 adjacent the heel, toe, top ridge and bottom sole portions and bounds a cavity 24. The rear surface 20 defines the bottom of the cavity 24.

A first weight portion 26 extends from the rear surface 20 and is disposed on the rear surface 20 behind the center of percussion 18. Preferably, the first weight portion 26 extends from the peripheral mass 22 adjacent the bottom sole portion 8 of the club head and is spaced from the peripheral mass adjacent the top ridge, heel and toe portions.

Figure 5:
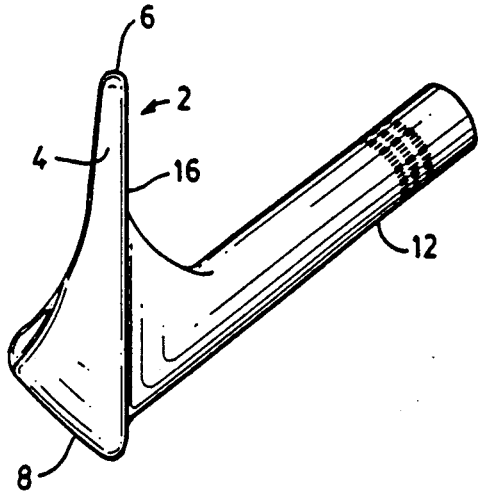
FIG. 5 is a toe end view thereof.
Figure 6:
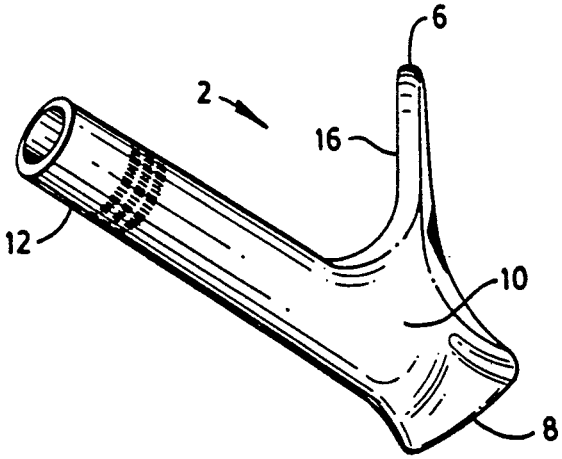
FIG. 6 is a heel end view thereof.

Referring to FIGS. 1, 2 and 5, it will be apparent that the thickness, and therefore the weight, of the peripheral mass 22 adjacent the bottom sole portion 8 substantially exceeds the thickness and weight of the peripheral mass adjacent the top ridge portion 6. Accordingly, a first wall 30 of the cavity 24 formed by the peripheral mass 22 adjacent the bottom sole portion 8 upstands from the rear surface 20 to an extent substantially greater than a second wall 32 of said cavity 24 formed by the peripheral mass adjacent the top ridge portion 6.

In like manner, the weight portion 26 has a thickness at its juncture with the peripheral mass 22 adjacent the bottom sole portion 8 substantially exceeding its thickness at its edge 34 closest the top ridge portion 6. However, in all instances the extent of the weight portion 26 from the bottom 20 of the cavity 24 is less than the maximum extent of the peripheral mass 22, that is, less than the extent of the peripheral mass adjacent the bottom sole portion 8.

A second weight means 36 extends from the rear surface 20 and is disposed within the peripheral mass 22. The second weight means 36 may be in the form of a strut mexler 38 extending from a first juncture 40 with the peripheral mass 22 to a second juncture 42 with the peripheral mass (FIGS. 1 and 2). In this embodiment, the second weight means 36 is wholly spaced from the first weight portion 26 and the center of percussion 18 and adds mass, and therefore weight, to the toe area of the club head.

Figure 7:
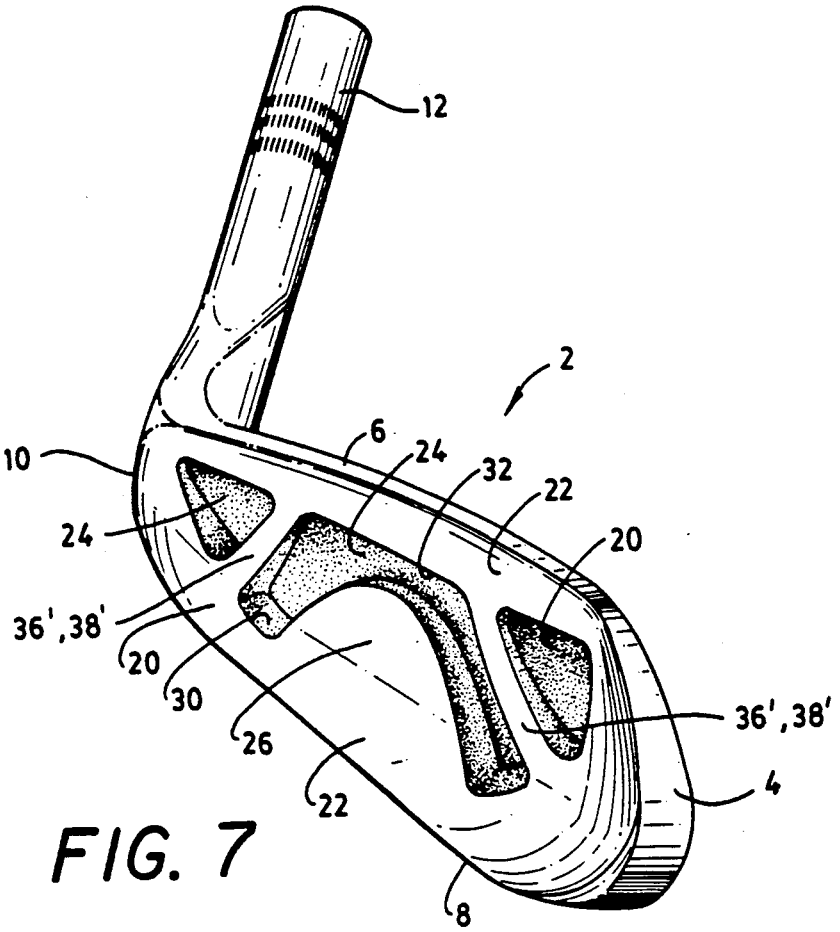
FIGS. 7 and 8 are perspective views of an alternative form of golf club head illustrative of an alternative embodiment of the invention.
Figure 8:
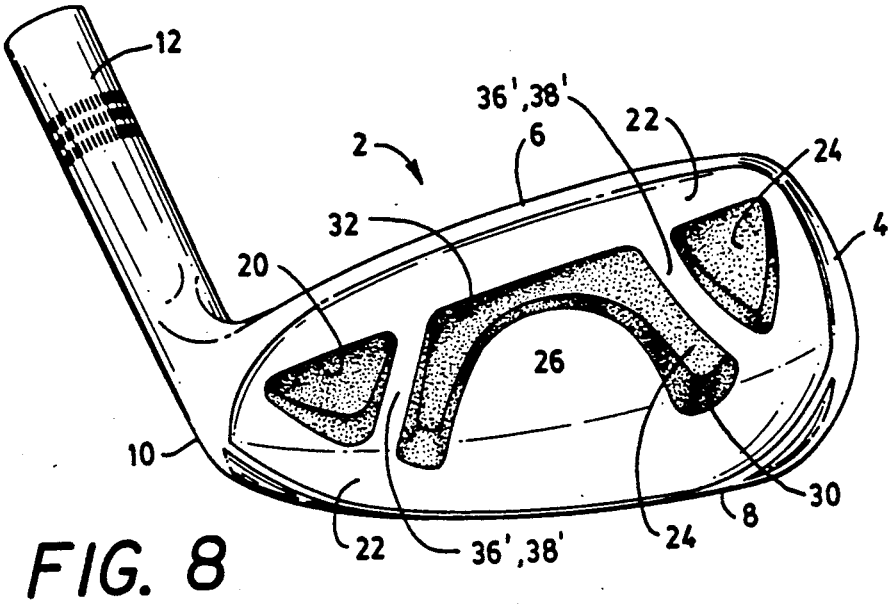

In an alternative embodiment (FIGS. 7 and 8), the second weight means 36 comprises a pair of strut members 38', both of the strut members 38', extending from a first juncture with the peripheral mass to a second juncture with the peripheral mass. In this embodiment, both strut members are wholly spaced from the first weight portion 26 and the center of percussion, and add weight to both the heel and toe areas of the club head.

Figure 9:
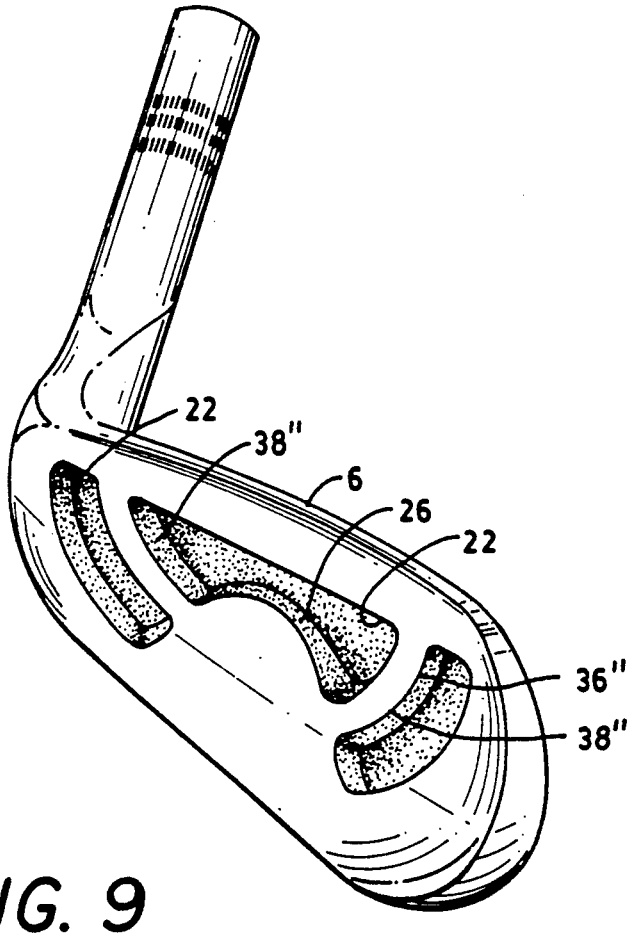
FIG. 9 is a perspective view of another alternative form of golf club head illustrative of another alternative embodiment of the invention.

In another alternative embodiment (FIG. 9), the second weight means 36'' may be in the form of one or more strut members 38'' extending from the first weight portion 26 to the peripheral mass 22. In this embodiment, the strut members 38'' preferably extend from the first weight portion 26 to the peripheral mass 22 adjacent the top ridge portion 6.

The club head blade member 2 is formed of metal and the peripheral mass 22 is a solid metal mass of the same metal as the club head blade member 2. The first weight portion 26 is a solid metal extension of the peripheral mass, the first weight portion 26 extending from the peripheral mass 22 at a single location adjacent the bottom sole portion 8, from which the first weight portion 26 extends inwardly of the cavity 24 and occupies the aforesaid location behind the center of percussion 18. As seen in FIG. 1, the majority of the periphery of the first weight portion 26 is bounded by the cavity 24. Thus, aside from the aforesaid single location, the first weight portion 26 is spaced from the peripheral mass 22. The second weight means, 36 or 36', is also formed of the same metal as the club head blade member 2 and the first weight portion 26 and comprises one or more solid metal struts.

Thus, there is provided an iron type golf club head having peripheral weighting, a first weight portion directly behind the center of percussion, and a second weight means within the peripheral mass but at least in part spaced from the first weight portion and the center of percussion to attain whatever weight distribution might be deemed desirable for the particular club and the particular skill level to which the club is directed.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. An iron type golf club head comprising a heel portion, a toe portion, a bottom sole portion, a top ridge portion, a hosel portion, a face surface having a center of percussion, a rear surface, a peripheral mass formed onsaid rear surface adjacent said heel, toe, bottom sole and top ridge portions, said peripheral mass defining a cavity, a bottom of said cavity being defined by said rear surface, a first weight portion extending from said rear surface and being disposed behind said center of percussion, said first weight portion extending from said peripheral mass adjacent said bottom sole portion and spaced from said peripheral mass adjacent said top ridge portion and said heel and toe portions, and a second weight means extending from said rear surface, said second weight means extending from said peripheral mass and from said first weight portion, whereby to interconnect said peripheral mass and said first weight portion.

2. The invention in accordance with claim 1 in which the thickness and weight of said peripheral mass adjacent said bottom sole portion substantially exceeds the thickness and weight of said peripheral mass adjacent said top ridge portion and in which a first wall of said cavity formed by said peripheral mass adjacent said bottom sole portion upstands for said rear surface to an extent substantially greater than a second wall of said cavity formed by said peripheral mass adjacent said top ridge portion.

3. The invention in accordance with claim 2 in which the extent of said first weight portion and second weight means from said bottom of said cavity is less than the maximum extent of said peripheral mass.

4. The invention in accordance with claim 1 in which said first weight portion comprises a solid metal portion bounded on the majority of its periphery by said cavity.

5. The invention in accordance with claim 4 in which said head is formed of metal, said peripheral mass is a solid metal mass, and said first weight portion comprises a solid metal extension of said peripheral mass adjacent said bottom sole portion, extending inwardly of said cavity and occupying said disposition behind said center of percussion.

6. The invention in accordance with claim 5 in which said first weight portion has a thickness at its juncture with said peripheral mass adjacent said bottom sole portion substantially exceeding its thickness at its edge closest said top ridge portion.

7. The invention in accordance with claim 1 in which said second weight means comprises at least one strut extending from said first weight portion to said peripheral mass.

8. An iron type golf club head comprising a heel portion, a toe portion, a bottom sole portion, a top ridge portion, a hosel portion, a face surface having a center of percussion, a rear surface, a peripheral mass formed on said rear surface adjacent said heel, toe, bottom sole and top ridge portions, said peripheral mass defining a cavity, a bottom of said cavity being defined by said rear surface, a first weight portion extending from said rear surface and being disposed behind said center of percussion, said first weight portion extending from said peripheral mass adjacent said bottom sole portion and spaced from said peripheral mass adjacent said top ridge portion and said heel and toe portions, said first weight portion having a thickness at its juncture with said peripheral mass adjacent said bottom sole portion substantially exceeding its thickness at its edge closest said toridge portion, and a second weight means extending from said peripheral mass and from said rear surface and at least in caret spaced from said first weight portion.

9. The invention in accordance with claim 8 in which said first weight portion extends from said peripheral mass at a single location and is otherwise spaced from said peripheral mass and said second weight means comprises a strut member extending from a first juncture on said peripheral mass to a second juncture on said peripheral mass, said strut member being wholly spaced from said first weight portion.

10. The invention in accordance with claim 9 in which said second weight means comprises a second strut member extending from a third juncture on said peripheral mass to a fourth juncture on said peripheral mass, said second strut member being wholly spaced from said first weight portion.

11. The invention in accordance with claim 8 in which said second weight means comprises at least one strut extending from said first weight portion to said peripheral mass.

* * * * *